United States Patent [19]

Abrahamsen et al.

[11] 4,245,786

[45] Jan. 20, 1981

[54] OSCILLATING LAWN SPRAY WITH VARIABLE WIDTH AND LENGTH

[76] Inventors: Johan E. Abrahamsen, c/o George Spector 3615 Woolworth Bldg., 233 Broadway; George Spector, 3615 Woolworth Bldg., 233 Broadway, both of New York, N.Y. 10007

[21] Appl. No.: 30,326

[22] Filed: Apr. 16, 1979

[51] Int. Cl.[3] ..... B05B 3/16

[52] U.S. Cl. ..... 239/242; 239/265; 239/546; 239/602; 239/DIG. 1

[58] Field of Search ..... 239/229, 242, 264, 265, 239/546, 566, 567, 587, 602, DIG. 1

[56] References Cited

U.S. PATENT DOCUMENTS

| | | | |
|---|---|---|---|
| 2,952,413 | 9/1960 | Jepson | 239/242 |
| 3,047,240 | 7/1962 | Lent | 239/265 |
| 3,498,543 | 3/1970 | Gilmour | 239/242 |
| 3,559,888 | 2/1971 | Miklos | 239/242 |

FOREIGN PATENT DOCUMENTS

| | | | |
|---|---|---|---|
| 172230 | 8/1952 | Austria | 239/229 |

*Primary Examiner*—Robert B. Reeves
*Assistant Examiner*—Michael J. Forman

[57] ABSTRACT

A lawn sprinkler having a perforated spray hose that is selectively flexed into a desired curvature and secured fixedly in the desired curvature in order to produce a variable water spray pattern, the device including, in one design, an adjustable jack mounted on rotatable adapters at the hose ends.

6 Claims, 16 Drawing Figures

RIGHT
FULL
PARTIAL
LEFT

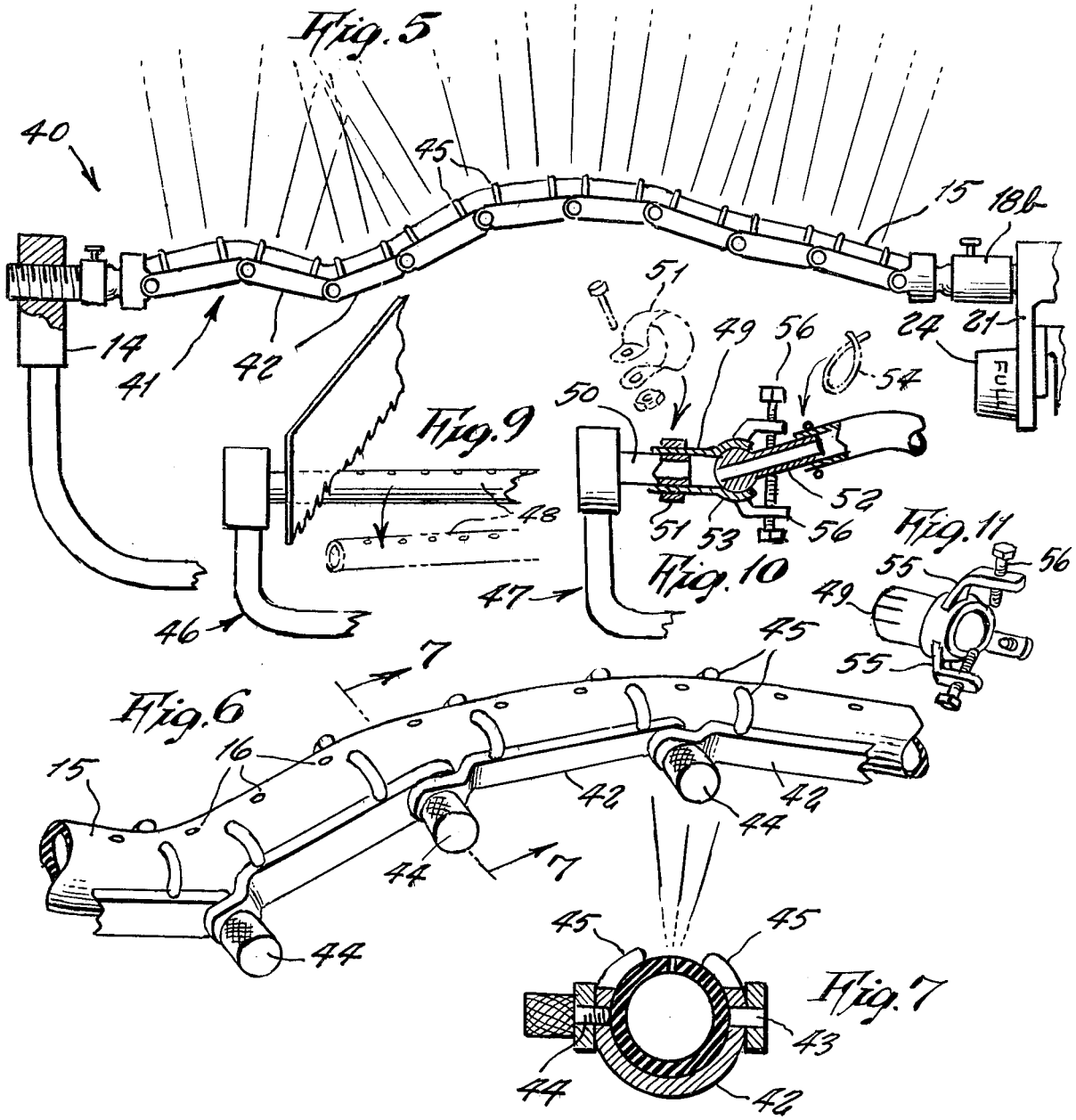
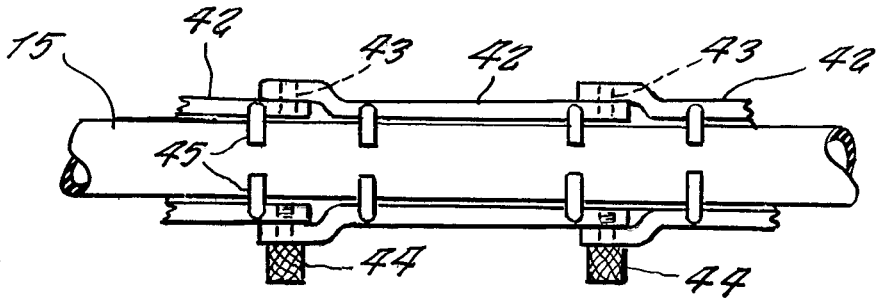
Fig. 8

RIGHT
15
21
35
58
59
60
61
62
63
64
65
11
11a
18a
18b
57
14

OSCILLATING LAWN SPRAY WITH VARIABLE WIDTH AND LENGTH

This invention relates generally to lawn sprinklers of oscillating type.

Heretofore such lawn sprinklers have been designed to spray a continuously same spray pattern which is of course, undesirable if some areas develop a need for more water than another area, such as sun exposed lawn areas not under shade trees or a flower garden where certain flowers require more water than others.

This situation is accordingly in need of an improvement.

Therefore it is a principal object of the present invention to provide an oscillating lawn sprinkler that can be varied in spray density through a sprayed area, as wished.

Another object is to provide an oscillating lawn sprinkler in which the spray area can be selectively controlled in width and length, so as to confine the spraying to the growing plant area and off a foot path, sidewalk or driveway.

Still another object is to provide an oscillating lawn spray with variable width and length which can be readily converted from an existing conventional lawn sprinkler having a straight, perforated spray pipe. In the drawings:

FIG. 1 is a perspective view of one design of the invention.

FIG. 1*a* is a cross sectional view on line 1*a*—1*a* of FIG. 1.

FIG. 1*b* is a side view of an expandable joint at the top of the jack.

FIG. 5 is a fragmentary side view of another design of the invention in which a segmented support holds the spray pipe in any desired bent up shape.

FIG. 6 is an enlarged detail thereof shown in perspective.

FIG. 7 is an enlarged cross sectional view taken on line 7—7 of FIG. 6.

FIG. 8 is a top view thereof.

FIG. 9 is a fragmentary side view showing an existing, conventional sprinkler being converted into the present invention, by sawing of the middle portion of the straight spray pipe, in order to be replaced by the flexible hose.

FIG. 10 is a side view of the device of FIG. 9, after the sawn off pipe is removed and replaced with an adapter on which the hose is fitted, the adapter being able to bend the hose as wished.

FIG. 11 is a perspective view of one of the components of the adapter shown in FIG. 10.

Figures 1, 1A, 1B, 2, 3, 3A, 4:
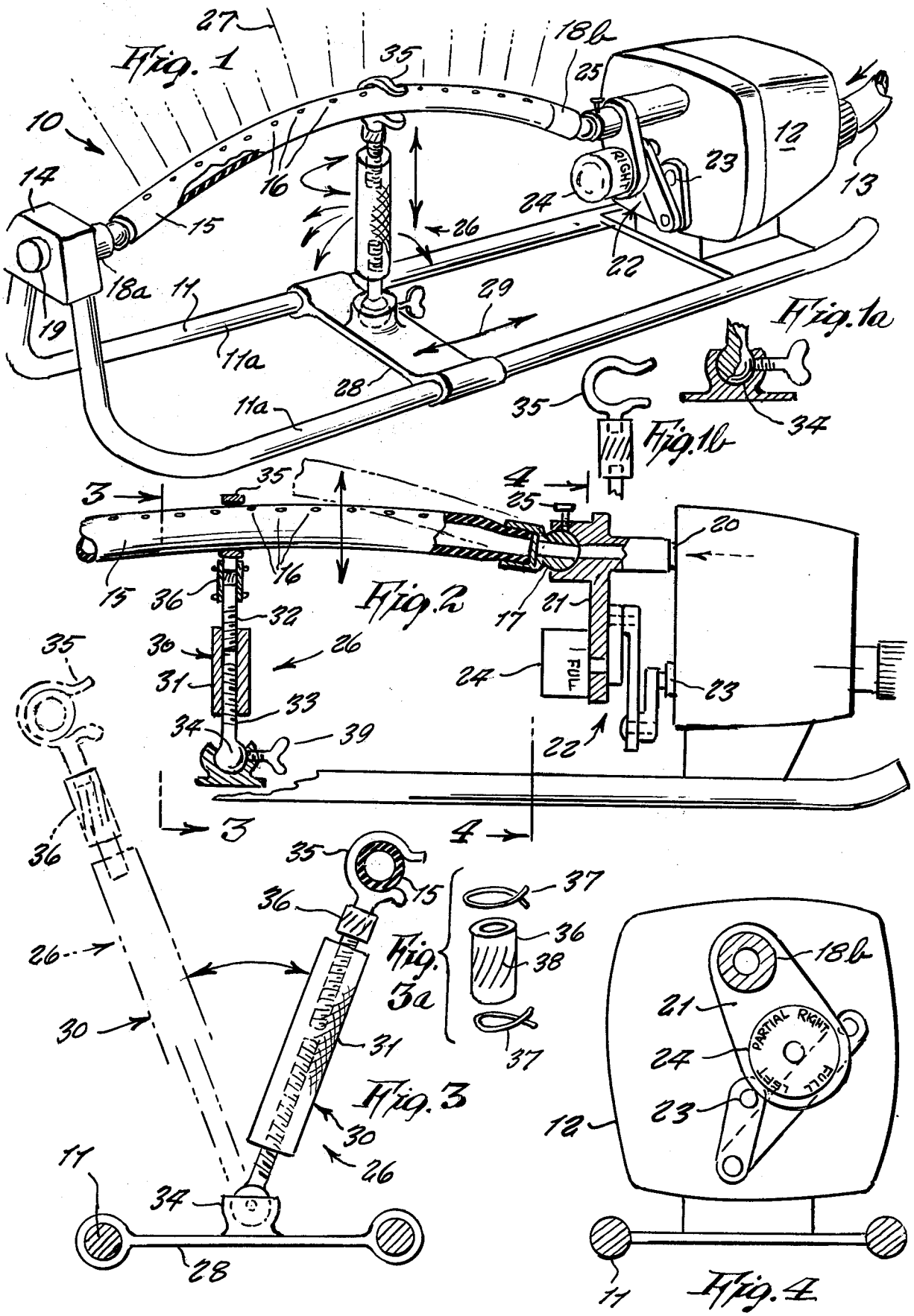
FIG. 2 is a side view of the design illustrated in FIG. 1, shown fragmentarily and partly in cross section.
FIG. 3 is a cross sectional view on line 3—3 of FIG. 2.
FIG. 4 is a cross sectional view taken on line 4—4 of FIG. 2.

Referring now to the drawing in greater detail, and more particularly to FIGS. 1 through 4 thereof, at this time, the reference numeral 10 represents an oscillating lawn spray with variable width and length, according to the present invention wherein there is pipe frame 11 upon one end of which there is mounted a water-driven, turbine motor 12, to which a garden hose 13 is attached. The opposite end of the frame is upwardly bent and is connected to a bearing block 14.

A flexible spray hose 15, perforated with a row of holes 16 is fitted at each opposite end on an adapter having a ball and socket joint 17. Adapter 18*a* is designed to fit rotatably into a hole 19 of the bearing block 14, while the other adapter 18*b* is designed to fit on a ball socket of nipple 20 extending from the motor. The adapter 18*b* is made with an arm 21, integral therewith and which is connected pivotally to a mechanism 22 that controls oscillating rotation of the adapter 18*b*, by means of a shaft 23 of the mechanism being rotationally being powered by movement of water through the turbine motor. A conventional manually operated control knob 24 on the mechanism 22 selectively confined the oscillation to the directions shown on the knob, as best illustrated in FIG. 4. Nipple 20, arm 21, knob 24 mechanism 22 and motor 12 are conventional in the trade and further description thereof is not necessary.

Thus oscillation of the adapter 18*b* is transmitted to the hose, for a corresponding oscillating movement. Set screw 25 may be used to prevent lost motion at the ball joint.

A jack 26 serves to retain the hose in a curved shape as shown in FIG. 1 so that water spray 27 is in a controlled fan-shaped pattern, as shown. The jack is fully adjustable in order to vary the hose curve and fan spray pattern. The jack is mounted upon a plate 28 slidable on frame 11 in a longitudinal direction as indicated by arrow 29 so that the jack can retain any portion of the hose. The jack includes a turnbuckle 30 comprised of barrel 31 and oppositely threaded screws 32 and 33, so that the jack is expandable. A universal ball and socket joint 34 at the lower end of the jack allows it to pivot in any direction. The upper end of the jack includes a clamp 35 for clipping around the hose. A stretchable rubber sleeve 36, between the clamp and turnbuckle, is secured thereto by wire clips 37. Diagonal slits 38 in the sleeve cause the sleeve to apply a rotational torsion force to the clamp when the sleeve is stretched, so to give an additional sideward curve to the hose when so wished. Thus the hose, curved by the jack extension as indicated by arrow 38, can additionally be made slightly spiralled. A set screw 39 locks the universal joint 34, as wished.

In use, the hose snap can thus be controlled to produce any varied spray pattern.

In FIGS. 5 through 8, another design 40 of the invention differs from design 10 by using a segmented brace 41 between the adapters, the brace being adjustable so to bend upwardly or downwardly any different portion of the hose, as wanted, so to produce a greater variety of water spray pattern, as shown in FIG. 5.

The brace is comprised of trough-shaped segments 42 attached pivotally together by transversely aligned pivot pins 43 and screws 44. The hose is laid in the trough of the segments and is held therein by fingers 45 that embrace around the top of the hose, by tightening the screws 44, the segments are locked together rigidly so to form any desired shape of brace for the hose.

In FIGS. 9 through 11, a means is shown whereby an existing sprinkler 46 is convented into an oscillating lawn spray 47 with variable width and length according to the present invention. The existing straight spary pipe 48 is sawn off near each end as shown in FIG. 9, after which an adapter 49 is fitted on each end 50 and secured thereto by a clamp 51. The adapter includes a nipple 52 connected thereto by a universal ball and socket joint 53. The hose 15 is fitted on the nipple and secured thereto by a wire clip 54. The adapter is made with three arms 55 each of which has a set screw 56 threaded therethrough so that the set screws can bear against a side of the nipple. Thus the nipple can be locked at any angle as shown so to curve the hose in any direction as much as wished.

It is to be noted that the frame and mechanism for oscillating the spray hose is conventional in the trade.

Figures 12, 13, 14:
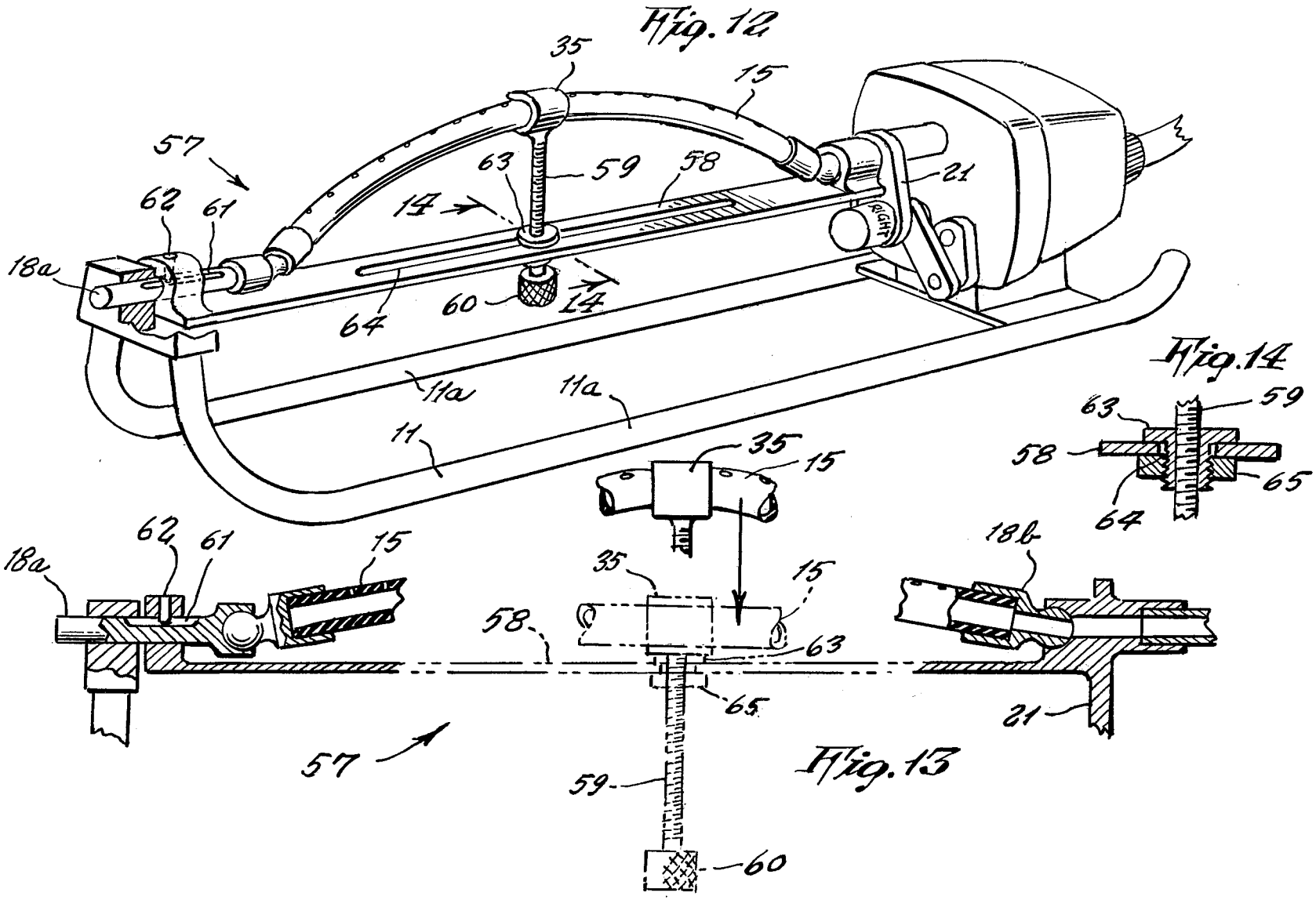
FIG. 12 is a perspective view of still another design in which a hose curve supports oscillates together with the hose.
FIG. 13 is an enlarged fragmentary side cross sectional view thereof, and showing in phantom lines the hose in a straightened position.
FIG. 14 is a cross sectional view on line 14—14 of FIG. 12.

FIGS. 12 to 14 illustrate still another design 57 of the invention wherein the above described jack 26 braced against a plate 28 held between the skids 11*a* of frame 11 is replaced by a bar 58 and a screw 59 supported thereupon, the screw having clamp 35 formed integrally on one end thereof and a knob 60 integrally with its other end.

The bar 58 is made integrally at one end with the arm, and the opposite end of the bar is supported on adapter 18*a*.

Thus in operative use, as the arm 21 oscillates reciprocally, both the hose 15 and the bar 58 oscillate together therewith as a single unit.

In this design, in order to allow the hose to flex between the curved position shown in FIG. 12 and a straightened position as shown by phantom lines in FIG. 13, the screw 59 moving throg through the bar, permits the hose to be brought closeby to the bar.

While the curving of the hose causes the adapter 18*a* to slide in hole 19, due to shortening of straight line distance between the adapter, the distance between opposite ends of the bar 58 is constant. Accordingly, if it is wished that adapter 18*a* oscillate together with the hose and bar, a keyway 61 is made in the adapter 18*a*, and a pin 62 affixed on the bar slides in the keyway, permitting sliding of the adapter relative to the bar, while holding the two rotatingly together.

As shown, the screw is adjustable in position along the bar by being threaded in a sleeve 63 slidable in a slot 64 along the bar, the sleeve being secured in a selected position by means of a nut 65.

What is claimed:

1. An oscillating lawn spray device with variable width and length of spray area, comprising a frame having a water driven oscillating mechanism at one end and a bearing block at the opposite end spaced from said mechanism, said mechanism including a inlet adapted for connection to a water supply and rotatable outlet fitting oscillated by said mechanism in combination with a flexible spray hose having spaced perforations, said hose being secured at one end to said fitting and at its other end to an adapter mounted on said block providing for hose rotation relative to said block, in further combination with means on said device for varying the curvature of said spray hose causing thereby variations in the length of the spray pattern due to the angular change in the direction of emission of each spray stream from said holes, said means including an adjustable member contacting said hose at various longitudinal positions thus causing varying hose contours.

2. The combination as set forth in claim 1, wherein said means includes an extendable jack, pivotally and movably mounted relative to said frame and hose, an outward end of said jack having a clamp for supporting adjustably said hose, said jack including a turnbuckle for extending the jack, further including means coacting with said jack to cause lateral curvature of said hose simultaneously with curvature due to jack extension.

3. The combination as set forth in claim 1, wherein said hose is secured to a brace comprised of segments pivotally connected together by means of set screws, said set screws selectively locking said segments rigidly together, each segment being secured to the hose at spaced locations.

4. The combination as set forth in claim 1, wherein said spray hose and adapter are removably mounted on said block and outlet fitting.

5. The combination as set forth in claim 4, including further means mounted on said adapter adjustably engaging the hose to adjust the curvature of said hose.

6. The combination as set forth in claim 1, wherein said means further comprises a bar affixed at one end to said outlet fitting and mounted at its opposite end adjustably on said adapter, said bar supporting said member at right angles thereto, said member being longitudinally adjustable along said bar and including means for varying the distance between said bar and contact with said hose wherein said adaptor is slidably mounted through said bar opposite end and said block, whereby said bar and hose will rotate together and said adapter will slide longitudinally relative to said block.

* * * * *